United States Patent [19]

Wendling

[11] Patent Number: 4,963,807

[45] Date of Patent: Oct. 16, 1990

[54] ULTRASONIC WEB EDGE GUIDE CIRCUIT

[75] Inventor: Jon Wendling, Algonquin, Ill.

[73] Assignee: Zip-Pak Incorporated, Northbrook, Ill.

[21] Appl. No.: 475,999

[22] Filed: Feb. 6, 1990

[51] Int. Cl.[5] ..... B65H 23/192; B06B 1/12

[52] U.S. Cl. ..... 318/632; 318/623; 318/638; 226/16; 264/24; 425/174.2

[58] Field of Search ..... 318/611, 623, 632, 638; 493/2, 19, 20, 196, 201; 226/16, 18, 19, 20, 45; 250/559, 571; 264/23, 24; 425/174, 174.2, 174.4

[56] References Cited

U.S. PATENT DOCUMENTS

| | | | |
|---|---|---|---|
| 3,268,140 | 8/1966 | Rouyer | 226/18 |
| 3,908,880 | 9/1975 | Russmann et al. | 11/45 X |
| 3,919,560 | 11/1975 | Nopper | 250/571 X |
| 4,049,213 | 9/1977 | Hank et al. | 226/20 X |
| 4,077,579 | 3/1978 | Seleski et al. | 226/20 X |
| 4,146,797 | 3/1979 | Nakagawa | 226/20 X |
| 4,291,825 | 9/1981 | Glanz | 226/18 |
| 4,303,189 | 12/1981 | Wiley et al. | 250/571 X |
| 4,779,782 | 10/1988 | Ricoux et al. | 226/18 X |
| 4,901,292 | 2/1990 | Schrauwen | 367/124 X |

*Primary Examiner*—Bentsu Ro

*Attorney, Agent, or Firm*—Hill, Van Santen, Steadman & Simpson

[57] ABSTRACT

An ultrasonic servo controller circuit is disclosed which is used to detect the edge of a web and adjust the web position as it is dispensed from a pay-off roll to packaging machinery. The circuit is utilized to control a motor which operates a linear actuator to "de-oscillate" the web thereby providing the packaging machinery with a steady, non-oscillating sheet of material.

18 Claims, 2 Drawing Sheets

ULTRASONIC WEB EDGE GUIDE CIRCUIT

BACKGROUND OF THE INVENTION

1. Field of the Invention

The present invention is directed to an ultrasonic sensor circuit which detects an edge of a material as it passes a specified point and controls a motor to adjust the position of the material in relation to the specified point. In particular, it is directed to an ultrasonic servo controller circuit which is utilized to detect the edge of a web as it proceeds from a pay-off roll to a packaging machine. The controller is used to control a motor which activates a linear actuator that laterally adjusts the position of the pay-off roll as the web is dispensed thereby keeping the web in substantial alignment with the packaging machine.

2. Description of the Prior Art

The food processing industry, as well as several other industries, routinely employ plastic containers having a zipper-type fastening at an open end which is used to seal in the contents of the container. The packaging and sealing of the containers typically takes place in a series of packaging machines which accept the packaging material as a web, formed as a continuous piece, from a pay-off roll.

Since the zipper-type fastening is located along one edge of the web, placing the web on the pay-off roll can be problematic. If the web is placed on the pay-off roll as a continuous piece, there tends to be an excessive build-up of the web material along the edge having the zipper-type fastening. Thus, the diameter of the web along the length of the pay-off roll is not uniform, the end of the roll having the fastening being significantly larger in diameter than the end not having the fastening. The uneven diameter of the pay-off roll which results may likewise prove to be problematic when dispensing the web from the pay-off roll to the packaging machinery.

To prevent this excessive build-up as the web is placed on the roll, the roll is oscillated laterally along its central axis. The amount of overlapping which occurs along the successive edges having the zipper-type fastening is significantly limited as a result.

Oscillation of the roll as the web is placed on the roll creates certain obstacles which must be overcome when the web is subsequently dispensed therefrom to the packaging machinery. Some means must be used to compensate for the unique manner in which the web is placed on the roll. The means of compensation must enable the packaging machinery to receive a steady, non-oscillating stream of web.

It is known to employ infrared servo systems to "de-oscillate" the web as it is dispensed to the packaging machinery. However, such systems are highly complex, expensive and are fraught with practical limitations. The limitations result primarily from the inherent sensitivity which the infrared sensor circuits display to the gauge of the web, the reflectivity of the web material and the presence or absence of web graphics.

SUMMARY OF THE INVENTION

An ultrasonic servo controller circuit is disclosed which is used to detect the edge of a web and adjust the web position as it is dispensed from a pay-off roll to packaging machinery. The circuit is utilized to control a motor which operates a linear actuator to "de-oscillate" the web thereby providing the packaging machinery with a steady, non-oscillating sheet of material.

An ultrasonic sensor unit, comprising a transmitter and a receiver, is disposed between the pay-off roll and the packaging machinery. The transmitter and receiver are located in spaced apart relation and positioned to created an open space therebetween through which the web may proceed. The strength of the ultrasonic signal at the sensor receiver is dependent on the amount of lateral obstruction caused by the web between the receiver and the transmitter. The more of the web that is located therebetween, the smaller the signal strength. Unlike an infrared sensor, the signal strength associated with the ultrasonic sensor is not affected by the reflectivity or gauge of the web. Nor is it effected by any web graphics.

The sensor output signal at the sensor receiver is processed by detection circuitry that provides a d.c. voltage level which is proportional to the strength of the ultrasonic signal received. The amplitude of the d.c. voltage level is level detected by a control circuit which generates signals used to control the power that is supplied to an oscillating motor. The power supplied to the oscillating motor determines both the speed and direction of oscillation.

The oscillating motor is employed to activate a linear actuator which oscillates the pay-off roll laterally along its central axis as web is dispensed. If there is too much web located in the space between the ultrasonic transmitter and receiver, the oscillating motor is activated to cause the linear actuator to move the pay-off roll in a first lateral direction to decrease the amount of web between the transmitter and receiver. Likewise, if there is not enough web located between the ultrasonic transmitter and receiver, the oscillating motor is activated to cause the linear actuator to move the pay-off roll in a second direction, opposite the first direction, to increase the amount of web disposed between the ultrasonic transmitter and receiver. In each instance, the oscillating motor is activated until the desired amount of web is present between the ultrasonic transmitter and receiver, the desired amount of web being the amount which is detected when the edge of the web is located directly between the ultrasonic transmitter and receiver.

By oscillating the pay-off roll in the above-stated manner as the web is dispensed, the web is effectively perceived by the packaging machinery as being de-oscillated. The ultrasonic servo control circuit controls the pay-off roll position to keep the edge of the web in fixed alignment with the packaging machinery as the web is dispensed. Thus, the packaging machinery is not affected by the manner in which the web has been placed on the pay-off roll.

A dancer arm assembly may be utilized to assist in avoiding excessive web tension as it is fed from the pay-off roll to the packaging machinery. The dancer arm assembly uses dancer arm start and stop sensors which are placed in spaced apart relation respectively at the upper and lower dancer arm positions. As the web in the dancer arm assembly is consumed by the packaging machinery, the dancer arm proceeds to its upper position thereby activating the start dancer arm sensor. Similarly, when there is a sufficient amount of slack on the web in the dancer arm assembly, the dancer arm activates the stop dancer arm sensor.

The outputs of the dancer arm sensors are fed to a dancer arm logic circuit. The dancer arm logic circuit is used to control the power supplied to a pay-off motor which rotates the pay-off roll about its central axis to dispense the web.

The pay-off motor is operated in a cyclic fashion. As the packaging machinery consumes the web, the dancer arm is forced upward, proximate the start dancer arm sensor. Once the start dancer arm sensor is activated, the dancer arm logic circuit actuates the pay-off motor to begin dispensing web. Typically, the pay-off motor dispenses web faster than it is consumed by the packaging machinery. Consequently, a certain amount of slack in the web will occur. As the slack increases to a predetermined level, the weight of the dancer arm causes it to proceed to its lower position where it activates the stop dancer arm sensor. The output of the stop dancer arm sensor is then detected by the dancer logic circuit to cause the dancer arm logic circuit to remove power from, and thus deactivate, the pay-off motor. As the packaging machinery consumes the slack, the dancer arm once again proceeds upward until it activates the start dancer arm sensor and reinitiates the pay-off motor cycle.

When the slack has increased to the point at which the lower dancer arm sensor is activated, there is no need to further adjust the position of the web, vis-a-vis the pay-off roll, with the oscillating motor. Thus, an output from the dancer arm logic circuit may be supplied to the control logic circuit to deactivate the oscillating motor approximately 5 seconds after the pay-off motor is deactivated.

BRIEF DESCRIPTION OF THE DRAWINGS

Other objects, features and advantages of the invention will best be understood from the following detailed description taken in conjunction with the accompanying drawings, of which.

DESCRIPTION OF THE PREFERRED EMBODIMENT

Figures 1, 2:
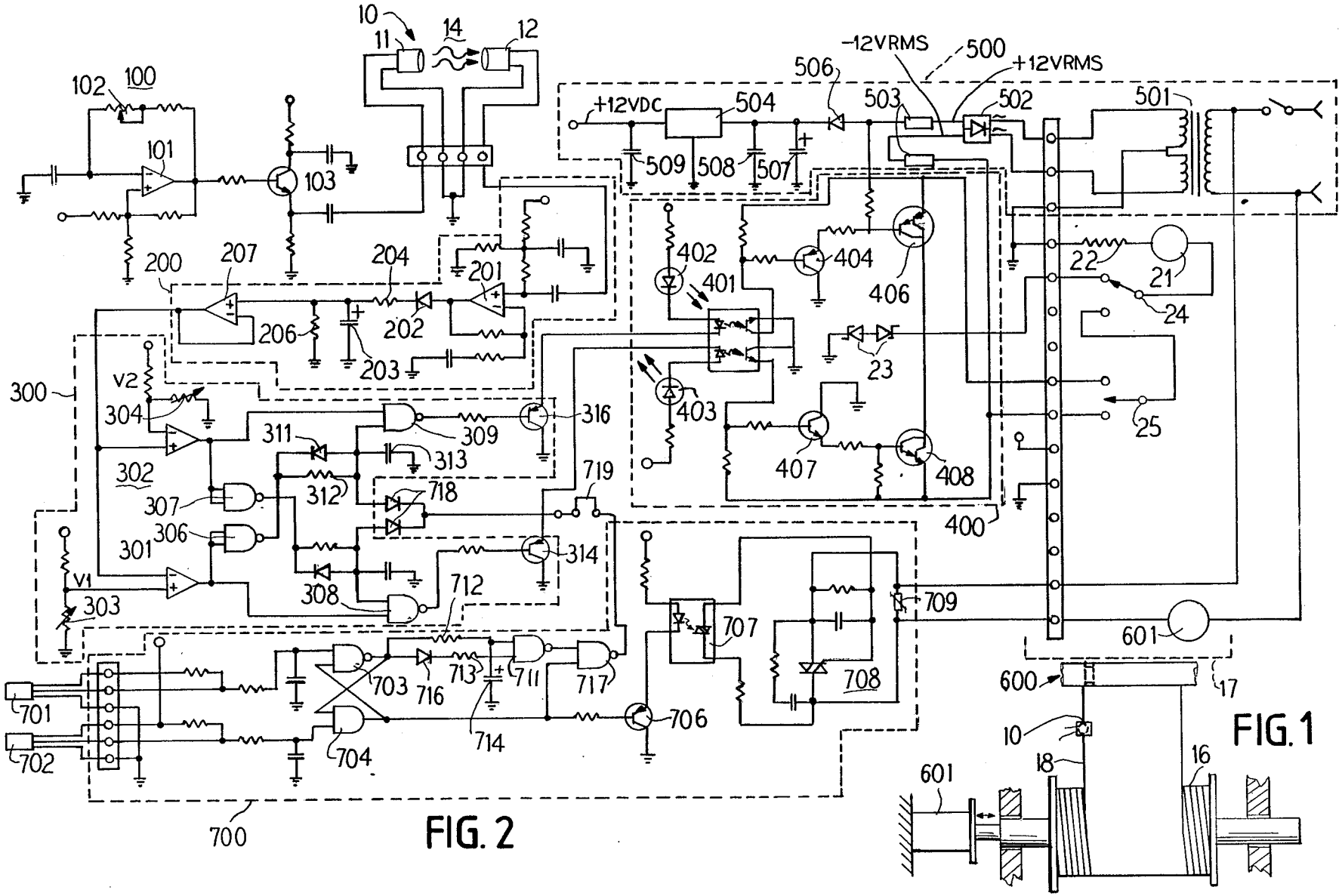
FIG. 1 shows placement of the ultrasonic sensor unit of the present invention in its operating position with respect to the pay-off roll, web and packaging machinery.
FIG. 2 is a schematic diagram of a preferred embodiment of the present invention.
Figure 3:
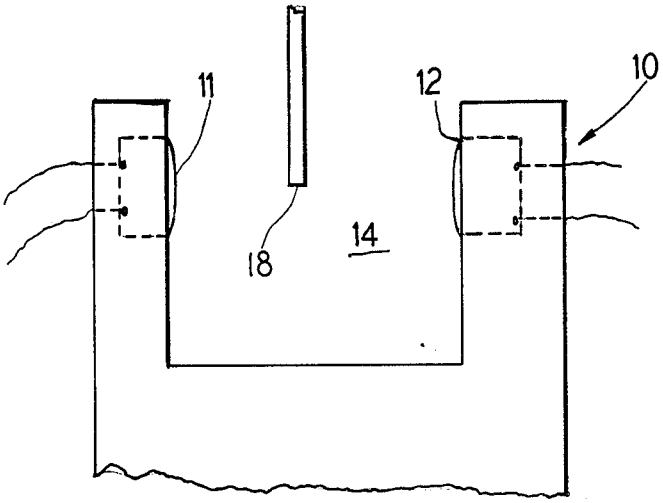
FIG. 3 is a plan view of the ultrasonic sensor unit used in the preferred embodiment of the invention.

As shown in FIG. 2, the present invention utilizes an ultrasonic sensor unit 10 which comprises a transmitter 11 and a receiver 12. In the preferred embodiment, the ultrasonic sensor unit 10 employs Panasonic Ultrasonic Transducers O40K2 and R40K2 as the transmitter and receiver, respectively. The transmitter 11 and receiver 12 are located in spaced apart relationship on a U-shaped bracket 13, such as shown in FIG. 3, with a gap 14 extending therebetween.

The ultrasonic sensor unit 10 is placed between the pay-off roll 16 and the packaging machinery 17 and is used to detect the edge of the web 18. The ultrasonic sensor unit 10 is positioned so that the edge of the web 18 proceeds through the gap 14.

An ultrasonic signal must be generated to traverse the gap 14 for reception at the receiver 12. To transmit the ultrasonic signal, a transmission circuit is provided. The transmission circuit comprises an ultrasonic oscillator circuit which is used to drive the transmitter of the ultrasonic sensor unit.

The ultrasonic oscillator circuit comprises the components enclosed in dotted box 100 of FIG. 2. The ultrasonic oscillator generates an ultrasonic frequency waveform. The waveform itself is generated by operational amplifier 101 and its associated components, the frequency being adjustable via a potentiometer 102 and being set to 40 KHz in the preferred embodiment. The output of operational amplifier 101 is supplied through a base resistor to drive an NPN transistor 103 which, in turn, drives the transmitter 11 of the ultrasonic sensor unit 10.

The output of the ultrasonic transmitter 11 is detected across the gap 14 by the receiver 12 of the ultrasonic sensor 10. The strength of the signal detected at the receiver 12 is proportional to the amount of web extending into the gap 14. For the purposes of the following discussion, the term "into the sensor" shall refer to movement of the web into the gap 14 toward the edge 19 of the U-shaped bracket 13, and the term "out of the sensor" shall refer to movement of the web out of the gap 14 away from the edge 19 of the U-shaped bracket 13. Because the web intercepts some of the energy transmitted by the ultrasonic transmitter 11, the signal strength detected at the receiver 12 decreases as the web moves into the sensor, while the signal strength detected at receiver 12 increases as the web is moved out of the sensor.

The output of the receiver signal is supplied to a detection circuit comprising the components enclosed in dotted box 200 of FIG. 2. In the detection circuit 200, the receiver output is first amplified by an a.c. amplifier comprising operational amplifier 201 and its associated components. The output of the amplifier is supplied to a peak detection circuit comprising diode 202, electrolytic capacitor 203 and resistors 204 and 206. The peak detector circuit of the preferred embodiment is designed having the discharge time constant of electrolytic capacitor 203 approximately 1000x greater than its charge time constant.

To maintain the integrity of the peak detected signal, the signal is buffered by a voltage follower 207 having a high input impedance. It is the output signal from the voltage follower 207 that constitutes the d.c. voltage level which is representative of the ultrasonic signal strength detected at the receiver 12. For the purposes of the following explanation, this d.c. voltage level shall be referred to as the signal strength voltage Vss.

The signal strength voltage Vss is supplied to a control logic circuit comprising the components shown enclosed in dotted box 300 of FIG. 2. The control logic circuit operates to supply output signals which are used to control the activation and direction of the oscillating motor 21.

Within the control logic circuit 300, the signal strength voltage Vss is supplied to the inputs of two comparator circuits 301, 302. Each of the comparator circuits has a threshold voltage V1, V2 that is adjustable via potentiometers 303 and 304 respectively. The threshold voltages 301, 302 define the operating levels of the signal strength voltage Vss that will cause the activation of the oscillating motor 21. Comparator 302 is configured to detect movement of the web out of the sensor (i.e., comparator 302 is used to detect an increase in the signal strength voltage Vss and goes to an active high output state when Vss exceeds the predetermined threshold value defined by V2). Similarly, comparator 301 is configured to detect movement of the web into the sensor (i.e., comparator 301 detects a decrease in the signal strength voltage VSS and goes to an active high output state when VSS drops below the predetermined threshold value defined by V1). Signal strength voltages between V1 and V2 fall within an allowable "dead zone". The "dead zone" defines the signal strength voltage levels that occur when the web is properly positioned between the sensors (i.e., when the edge of the web is positioned directly between the transmitter 11 and receiver 12).

The outputs of the comparator circuits 301, 302 are supplied to the inputs of NAND gates 306, 307, 308 and 309. These NAND gates are configured to ensure that the output signals from comparator circuits 301, 302 may only cause the activation of the oscillating motor 21 in a mutually exclusive manner. Thus, the signal outputs of comparator circuits 301 and 302 cannot both be simultaneously used to activate the oscillating motor 21. As can be seen in FIG. 2, NAND gates 306 and 307 are configured as inverters thereby enhancing the economic aspects of the construction of the circuit by using a four gate NAND I.C. package, i.e., a 4093 CMOS NAND gate in the preferred embodiment rather than adding a further inverter I.C.

As shown in FIG. 2, the outputs of NAND gates 306 and 307 are not directly supplied to the respective inputs of 309 and 308. Rather, each output passes through a noise reduction circuit. With respect to the output of 306, the noise reduction circuit comprises diode 311 resistor 312 and capacitor 313. Together, these components facilitate a slow low-to-high transition (RC=0.1 sec) of the signal supplied to the input of NAND gate 309 while facilitating a comparatively fast transition from the high-to-low levels. This difference in transition times increases the noise immunity of the logic circuit while simultaneously ensuring that the output signals of comparator circuits 301 and 302 are used to activate the oscillating motor in a mutually exclusive manner. A similar circuit is used between NAND gates 306 and 308.

The outputs of NAND gates 308 and 309 are used to drive PNP transistors 316 and 314, respectively. When the output of NAND gate 308 goes to a logic low level, PNP transistor 316 is allowed to conduct. Similarly, when the output of NAND gate 309 goes to a logic low level, PNP transistor 314 is allowed to conduct.

The emitter leads of each PNP transistor 314, 316 constitute the output of the control logic circuit 300. Transistor 316 conducts current when it is necessary to activate the oscillating motor 21 in the "in" direction (i.e., in the direction necessary to move the web into the sensor). Transistor 314 conducts current when it is necessary to activate the oscillating motor 21 in the "out" direction (i.e., in the direction necessary to move the web out of the sensor). When the edge of the web 18 is properly positioned in the gap 14, neither PNP transistor 314 nor 316 are allowed to conduct. Rather, they are in an open condition during such times.

The power control circuit, comprising the components enclosed in dotted box 400 of FIG. 2, accepts the emitter outputs of PNP transistor 314 and 316 of the control logic circuit 300 and uses such outputs to switch the power to the oscillating motor 21 and control its direction. To better comprehend the power control circuit 400, it is advantageous to consider the power control circuit in conjunction with the power supply, comprising the components enclosed in dotted box 500 of FIG. 2.

The power supply 500 of the preferred embodiment receives a line voltage of 120 VAC and converts the line voltage to provide the +12 VDC used to operate the electronic circuits as well as the fully rectified +12 VRMS and −12 VRMS used to power the oscillating motor 21. The line voltage is supplied to the primary of a transformer 501 having a center tapped secondary. The center tap of the secondary of the transformer output is connected to ground while the end leads of the secondary are supplied to the inputs of a bridge rectifier 502. One output of the bridge rectifier 502 provides the fully rectified +12 VRMS and the other provides the fully rectified −12 VRMS that is used to operate the oscillating motor. To prevent any excessive current draw due to a circuit malfunction, the outputs from the bridge rectifier 502 are protected with fuses 503, 503.

The fully rectified +12 VRMS (which is approximately +17V at its peak amplitude) is supplied to a +12V linear regulator 504 (preferably a 7812C) through a blocking diode 506. The linear regulator 504 provides the +12 VDC power used by the electronics.

Two capacitors 507,508 are provided between the input of the linear regulator 504 and ground. The first capacitor 507 is electrolytic and is used to filter the fully rectified +12 VRMS power at the linear regulator input and further assists in maintaining power to the linear regulator 504 in the event of a glitch in the line voltage. The second capacitor 508 is a standard capacitor which is used to filter noise spikes from the regulator input. Another capacitor 509 is placed between the output of the linear regulator 504 and ground and also assists in maintaining a constant +12VDC output to the electronics in the event of a glitch in the line voltage.

Returning to the power control circuit 400, it can be seen from FIG. 2 that the emitter outputs of PNP transistors 314 and 316 are connected to the inputs of an opto-isolator 401. When PNP transistor 316 conducts, current flows through an LED 402 as well as through the photodiode located within the opto-isolator 401. The LED 402 is used to provide a visual indication that the oscillating motor 21 is being activated to move the web into the sensor. The photodiode in the opto-isolator 401 causes the corresponding phototransistor within the opto-isolator 401 to conduct thereby activating the power transistor circuit comprising PNP transistor 404 and Darlington PNP transistor 406. When Darlington PNP transistor 406 conducts, the +12 VRMS that is connected to the emitter of transistor 406 is supplied to the oscillating motor 21 thereby causing the motor to move in the "in" direction.

A similar operational sequence occurs when PNP transistor 314 is in a conductive state. When PNP transistor 314 conducts, current flows through the LED 403 as well as through the photodiode located within the opto-isolator 401. The LED 403 is used to provide a visual indication that the oscillating motor 21 is being activated to move the web out of the sensor. The photodiode in the opto-isolator 401 causes the corresponding phototransistor to conduct thereby activating the power transistor circuit comprising NPN transistor 407 and Darlington NPN transistor 408. When Darlington transistor 408 conducts, the −12 VRMS that is connected to the emitter of Darlington transistor 408 is supplied to the oscillating motor 21 thereby causing the motor to move in the "out" direction.

Several standard circuits should be utilized to prevent any problems which might be associated with the operation of the oscillating motor 21. First, a power resistor 22 should be placed between the oscillating motor 21 and ground. This will limit the current flow through the Darlington transistors 406 and 408 in the event that the motor experiences a short circuit or a "jam". Second, a pair of oppositely biased zener diodes 23,23 should be placed between the line supplying the power to the oscillating motor and ground. This will assist in eliminating the spikes normally associated with switching power to inductive loads (i.e., motors).

Figure 4:
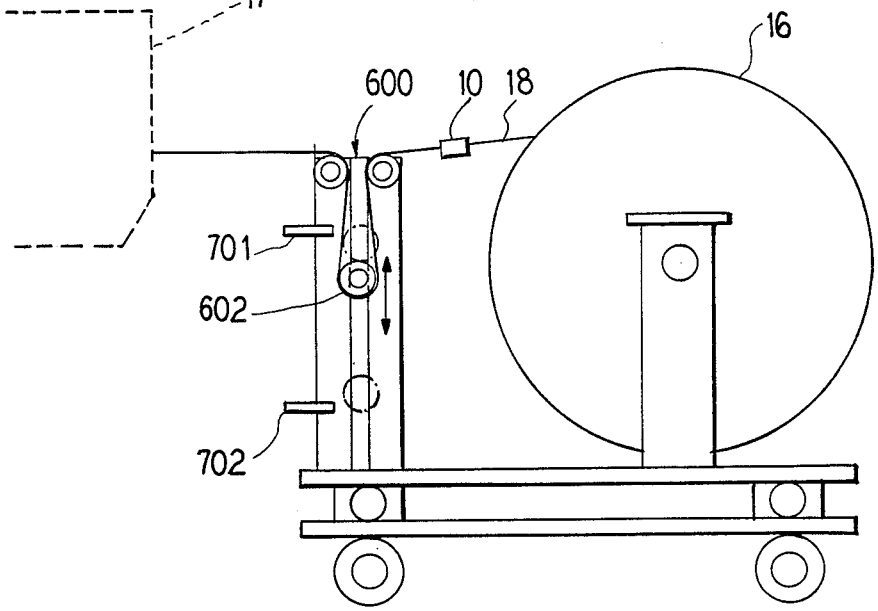
FIG. 4 shows the positional relationship between the dancer arm assembly, the pay-off roll and the ultrasonic sensor unit of the preferred embodiment of the invention.

To prevent the excessive accrual of tension on the web as it is fed from the pay-off roll 16 to the packaging machinery 17, a dancer arm assembly 600, such as that shown in FIGS. 2 and 4, may be employed. In such an assembly, the pay-off motor 601 turning the pay-off roll 16 is activated to dispense an amount of the web. The pay-off motor 601 is turned off after enough web has been dispensed from the pay-off roll 16 to cause the dancer arm 602 to reach its lower position. As the web is consumed by the packaging machinery 17, the dancer arm 602 begins rising until it reaches its upper position, at which point the pay-off motor 601 is once again activated.

A dancer arm logic circuit is shown comprising the components in dotted box 700 of FIG. 2. The dancer arm logic circuit 700 is used to control the activation and deactivation of the pay-off motor 601 based on the position of the dancer arm 602. The position of the dancer arm 602 is detected through the use of two sensors, the start dancer arm sensor 701 and the stop dancer arm sensor 702, which are located in the positions shown in FIG. 3. The dancer arm sensors are inductive proximity sensors which detect the presence of any metal in the dancer arm 602 when the dancer arm 602 is proximate the respective dancer arm sensor 701, 702. The output signal of the dancer arm sensors 701, 702 in the preferred embodiment are placed at a logic low level when the dancer arm 602 is proximate the respective dancer arm sensor 701, 702.

The output signals from the dancer arm sensors 701, 702 are supplied to the inputs of two NAND gates 703,704 which are connected in a latch configuration. The output signal from the start dancer arm sensor 701 is supplied to the input of NAND gate 703 and the output of the stop dancer arm sensor 702 supplied to the input of NAND gate 704. Since the NAND gates are connected in a latch configuration, the outputs of the NAND gates will retain their previous logic state so long as neither the start nor stop dancer sensor output signals are at a logic low level.

The output of NAND gate 704 is used to activate and de activate the pay-off motor 601. To accomplish this, the output signal from NAND gate 704 is used to drive PNP transistor 706 which, in turn, activates an opto-isolator 707. The output of the opto-isolator 707 is used to activate the triac circuit 708. In the preferred embodiment, the pay-off motor 601 is connected to receive power via the line voltage supply. To assist in preventing inductive spikes, a metal oxide varistor 709 is placed between the pay-off motor 601 and one of the lines associated with the line voltage supply.

In practice, it may be desireable to disable the oscillating motor 21 at a predetermined time after the pay-off motor 601 has been deactivated (i.e., after the stop dancer arm sensor 702 has been activated and the pay-off motor is no longer dispensing the web), and to re-enable the oscillating motor 21 when the pay-off motor 601 resumes dispensing web from the pay-off roll 16. Thus, at a predetermined time after the pay-off motor 601 has been deactivated (i.e., after having dispensed an amount of web to the dancer arm assembly 600), the oscillating motor 21 will be disabled. Once the pay-off motor 601 is reactivated and resumes dispensing the web, the oscillating motor 21 is re-enabled.

The output of NAND gate 703, in addition to being connected to the input of NAND gate 704, functions in the process of enabling and disabling the oscillating motor 21 in accordance with the activation and deactivation of the pay-off motor 601. The output of NAND gate 703 is supplied to both inputs of NAND gate 711 (here functioning as an inverter) through a timing circuit comprising resistors 712 and 713, capacitor 714 and diode 716. In the timing circuit, the value of resistor 712 is chosen to be significantly greater than the value of resistor 713. Thus, the timing circuit facilitates a fast rise time (RC=4.7 msec) of the signal supplied to NAND gate 711, while prolonging the fall time of the signal (RC=4.7 sec). In the preferred embodiment, the fall time is approximately equal to 4.7 seconds while the rise time is approximately equal to 4.7 msec.

NAND gate 717 receives its input signals from NAND gates 704 and 711 and generates an output signal based thereon which is supplied, through blocking diodes 718,718, to the control logic circuit 300. Within the control logic circuit 300, a logic level low signal at the output of NAND gate 717 will cause the outputs of NAND gates 308 and 309 to proceed to a logic level high state which, in turn, will ultimately disable the oscillating motor 21. If, however, the output from NAND gate 717 is at a logic level high, the blocking diodes 718,718 will ensure, that the ultimate operation of the of the oscillating motor will be dependent on the outputs of NAND gates 308 and 309.

Since the operation of the oscillating motor 21 in accordance with the operation of the pay-off motor 601 may not be desirable under all circumstances, the dependent operation of the oscillating motor 21 should be viewed as an optional feature. Consequently, a jumper 719 may be placed between the output of NAND gate 717 and the blocking diodes 718,718 thereby enabling the user to determine whether this feature is indeed necessary or desirable.

Manual operation of the oscillating motor 21 may be desirable under certain circumstances. Switches 24 and 25 are provided for this purpose. Switch 24 is used to select either manual or automatic operation. In the AUTO position, switch 24 connects the oscillating motor 21 to the collectors of Darlington transistors 406 and 408 thereby placing the oscillating motor 21 under the direct control of the servo circuit. However, when switch 25 is placed in the manual position (MAN), the power supplied to the oscillating motor 21 is determined by the position of switch 25.

Although modifications and changes may be suggested by those skilled in the art, it is the intention of the inventor to embody within the patent warranted hereon any changes and modifications as reasonably and properly come within the scope of this contribution to the art.

I claim:

1. An ultrasonic servo controller for de-oscillating a web as the web is dispensed from a pay-off roll, comprising:

transmission means for generating an ultrasonic frequency signal and for transmitting said ultrasonic frequency signal across a gap;

receiver means, accepting said ultrasonic frequency signal transmitted by said transmission means across said gap, for converting said ultrasonic frequency signal into a signal strength voltage, said signal strength voltage having a voltage level proportional to an amount of web disposed between said transmission means and said receiver means;

logic control means, accepting said signal strength voltage from said receiver means, for generating a first control signal when said voltage level of said signal strength voltage decreases below a first predetermined level, and for generating a second control signal when said voltage level of said signal strength voltage increases above a second predetermined level; and, motor control means, accepting said first and second control signals from said logic control means, for activating an oscillating motor to move said pay-off roll in a first direction in response to said first control signal, and for activating said oscillating motor to move said pay-off roll in a second direction in response to said second control signal, said first direction being a direction necessary to move an edge of said web out of said gap between said transmission means and said receiver means, said second direction being a direction necessary to move said edge of web into said gap between said transmission means and said receiver means.

2. An ultrasonic servo controller as recited in claim 1, wherein said first and second predetermined levels are of different values.

3. An ultrasonic servo controller as recited in claim 1, wherein said transmission means comprises an ultrasonic oscillator circuit connected to an ultrasonic transmitter.

4. An ultrasonic servo controller as recited in claim 1, wherein said receiver means comprises:

an ultrasonic receiver transducer having an a.c. voltage output with a peak voltage level that is proportional to a signal received from said transmission means;

an a.c. amplifier receiving said a.c. voltage from said ultrasonic receiver transducer;

a peak detector circuit receiving an amplified a.c. signal from said a.c. amplifier; and, a voltage follower, accepting a peak detected signal from said peak detector circuit, said voltage follower having an output as said signal strength voltage.

5. An ultrasonic servo controller as recited in claim 1, wherein said logic control means comprises:

a first level detector for comparing said signal strength voltage with a first reference voltage and for generating an output signal when said signal strength voltage falls below said first reference voltage, said first reference voltage representative of the voltage level of said signal strength voltage when said oscillating motor is to be moved in said first direction; and, a second level detector for comparing said signal strength voltage with a second reference voltage and generating an output signal when said signal strength voltage rises above said second reference voltage, said second reference voltage representative of the voltage level of said signal strength voltage when said oscillating motor is to be moved in said second direction.

6. An ultrasonic servo controller as recited in claim 5, wherein said logic control means further comprises:

a first invertor accepting said output signal of said first level detector, said first invertor having an output signal;

a second invertor accepting said output signal of said second level detector, said second invertor having an output signal;

a first NAND gate accepting said output signal of said second level detector and said output signal of said first invertor, said first NAND gate having an output signal;

a second NAND gate accepting said output signal of said first level detector and said output signal of said second invertor, said second NAND gate having an output signal;

a first PNP transistor having a base, emitter and collector, said base receiving said output signal of said first NAND gate, said collector connected to ground, and said emitter acting as said second control signal; and, a second PNP transistor having a base, emitter and collector, said base receiving said output signal of said second NAND gate, said collector connected to ground, and said emitter acting as said first control signal.

7. An ultrasonic servo controller as recited in claim 6, wherein said logic control means further comprises:

a first blocking diode interposed between said first invertor and said first NAND gate;

a first resistor connected in parallel with said first blocking diode;

a first capacitor connected between said first blocking diode, said first resistor and ground;

a second blocking diode interposed between said second invertor and said second NAND gate;

a second resistor connected in parallel with said second blocking diode; and, a second capacitor connected between said second blocking diode, said second resistor and ground.

8. An ultrasonic servo controller as recited in claim 1, wherein said motor control means comprises:

power supply means for generating a first supply voltage and a second supply voltage;

an opto-isolator accepting said first and second control signals from said logic control means, said opto-isolator generating a first actuating signal from said first control signal and a second actuating signal from said second control signal;

a PNP transistor having a base, emitter and collector, said base accepting said first actuating signal and said collector connected to ground;

a PNP Darlington transistor having a base, emitter and collector, said base accepting a signal from said collector of said PNP transistor, said emitter connected to said first supply voltage, said collector connected to said oscillating motor to activate said motor in said second direction in response to said first actuating signal;

an NPN transistor having a base, emitter and collector, said base accepting said second actuating signal and said collector connected to ground; and, an NPN Darlington transistor having a base, emitter and collector, said base accepting a signal from said collector of said NPN transistor, said emitter connected to said second supply voltage, said collector connected to said oscillating motor to activate said motor in said first direction in response to said second actuating signal.

9. An ultrasonic servo controller as recited in claim 1, further comprising:

a start dancer arm sensor for detecting a dancer arm when said dancer arm is in a first position, said start dancer arm sensor providing a first detection signal when said dancer arm is in said first position;

a stop dancer arm sensor for detecting said dancer arm when said dancer arm is in a second position, said stop dancer arm sensor providing a second detection signal when said dancer arm is in said second position; and, dancer arm control means, accepting said first and second detection signals, for activating a pay-off motor to dispense said web from said pay-off roll when said start dancer arm sensor detects said dancer arm in said first position and for deactivating said pay-off motor when said stop dancer arm sensor detects said dancer arm in said second position.

10. An ultrasonic servo controller as recited in claim 9, wherein said dancer arm control means further comprises means for deactivating said oscillating motor when said pay-off motor is deactivated.

11. An ultrasonic servo controller as recited in claim 9, wherein said dancer arm control means comprises:

a first NAND gate having a first input accepting said first detection signal, and further having an output;

a second NAND gate having a first input connected to said output of said first NAND gate, a second input accepting said second detection signal, and further having an output signal; and, a PNP transistor having a collector, an emitter and a base, said collector connected to ground, said base accepting said output signal from said second NAND gate, said collector utilized to activate and deactivate said pay-off motor.

12. An ultrasonic servo controller as recited in claim 11, wherein said dancer arm control means further comprises:

timing means connected to said output of said first NAND gate for delaying said output as it transitions from a logic level low state to a logic level high state, said timing means having a delayed output signal;

an inventor connected to receive said delayed output signal and having an inverted output; and, a third NAND gate having a first input connected to said inverted output of said invertor and a second input connected to receive said output signal of said second NAND gate, and further having an output signal, said output signal connected to said logic control means to cause said logic control means to deactivate said oscillating motor when said pay-off motor is deactivated.

13. An ultrasonic servo controller for de-oscillating a web as it is dispensed from a pay-off roll, comprising: receiver means for accepting ultrasonic waves and converting said ultrasonic waves into an a.c. voltage;

oscillator means for generating an ultrasonic frequency signal;

transmitter means for accepting said ultrasonic frequency signal from said oscillator means and transmitting ultrasonic frequency waves across a gap, said transmitter means disposed in a spaced apart relationship with said receiver means thereby forming said gap therebetween;

a.c. amplifier means for amplifying said a.c. voltage thereby to form an amplified a.c. voltage signal, said a.c. voltage at said receiver means having a voltage level which is dependent on an amount of web disposed in said gap between said transmitter means and said receiver means;

peak detection means for detecting a peak voltage level of said amplified a.c. voltage signal and for providing a signal strength voltage based on said peak voltage level;

level detection means, accepting said signal strength voltage, for generating a first signal when said signal strength voltage is at a voltage level less than a first predetermined voltage, and for generating a second signal when said signal strength voltage is at a voltage level greater than a second predetermined voltage, said first predetermined voltage being the minimum voltage level of said signal strength voltage that occurs when a maximum permissible amount of said web is disposed in said gap between said transmitter means and said receiver means, said second predetermined voltage being the maximum voltage level of said signal strength voltage that occurs when a minimum permissible amount of said web is disposed in said gap;

logic circuit means, accepting said first and second signals from said level detection means, for generating a first control signal in response to said first signal from said level detection means, and for generating a second control signal in response to said second signal from said level detection means, said logic circuit means providing means generating said first and second control signals in a mutually exclusive manner such that said first and second control signals are not active simultaneously; and, motor control means, accepting said first and second control signals from said logic circuit means, for activating an oscillating motor to move said pay-off roll in a first direction in response to said first control signal, and for activating said oscillating motor to move said pay-off roll in a second direction in response to said second control signal, said first direction being a direction necessary to move said web out of said gap between said transmission means and said receiver means, said second direction being a direction necessary to move said web into said gap between said transmission means and said receiver means.

14. An ultrasonic servo controller as recited in claim 13, further comprising:

a start dancer arm sensor for detecting a dancer arm when said dancer arm is in a first position, said start dancer arm sensor providing a first detection signal when said dancer arm is in said first position;

a stop dancer arm sensor for detecting said dancer arm when said dancer arm is in a second position, said stop dancer arm sensor providing a second detection signal when said dancer arm is in said second position; and, dancer arm control means, accepting said first and second detection signals, for activating a pay-off motor to dispose said web from said pay-off roll when said start dancer arm sensor detects said dancer arm in said first position and for deactivating said pay-off motor when said stop dancer arm sensor detects said dancer arm in said second position.

15. An ultrasonic servo controller as recited in claim 14, wherein said dancer arm control means further comprises means for deactivating said oscillating motor when said pay-off motor is deactivated.

16. A method for de-oscillating a web as it is dispensed from a pay-off roll comprising the steps of:

dispensing a web from a pay-off roll;

placing an ultrasonic transmitter and receiver in spaced apart relation at an edge of said web as said web is dispensed from said pay-off roll, said web proceeding through a gap between said ultrasonic transmitter and receiver;

using said ultrasonic transmitter to transmit an ultrasonic wave signal across said gap;

receiving said ultrasonic wave signal transmitted across said gap at said ultrasonic receiver;

ascertaining the amount of web in said gap by measuring the signal strength of said ultrasonic wave signal received at said receiver; and, controlling an oscillating motor in response to said signal strength of said ultrasonic wave signal thereby to increase said amount of web between said ultrasonic transmitter and receiver when said signal strength proceeds above a predetermined level and to decrease said amount of web between said ultrasonic transmitter and receiver when said signal strength decreases below a further predetermined level.

17. A method for de-oscillating a web as it is dispensed from a pay-off roll as recited in claim 16, further comprising the steps activating a pay-off motor to dispense said web from said pay-off roll in response to detection of an active signal from a start dancer arm sensor; and, deactivating said pay-off motor to inhibit dispensing of said web from said pay-off roll in response to detection of an active signal from a stop dancer arm sensor.

18. A method for de-oscillating a web as it is dispensed from a pay-off roll as recited in claim 17, further comprising the step of deactivating said oscillating motor whenever said pay-off motor is deactivated.

* * * * *